US006973918B2

(12) United States Patent
Boehland et al.

(10) Patent No.: US 6,973,918 B2
(45) Date of Patent: Dec. 13, 2005

(54) FUEL INJECTION DEVICE FOR AN INTERNAL COMBUSTION ENGINE

(75) Inventors: Peter Boehland, Marbach (DE); Tobias Reiser, Ehningen (DE)

(73) Assignee: Robert Bosch GmbH, Stuttgart (DE)

( * ) Notice: Subject to any disclaimer, the term of this patent is extended or adjusted under 35 U.S.C. 154(b) by 15 days.

(21) Appl. No.: 10/492,412

(22) PCT Filed: Feb. 25, 2003

(86) PCT No.: PCT/DE03/00585

§ 371 (c)(1),
(2), (4) Date: Apr. 12, 2004

(87) PCT Pub. No.: WO2004/018866

PCT Pub. Date: Mar. 4, 2004

(65) Prior Publication Data

US 2004/0262424 A1 Dec. 30, 2004

(30) Foreign Application Priority Data

Aug. 16, 2002 (DE) ..... 102 37 585

(51) Int. Cl.[7] ..... F02M 41/00
(52) U.S. Cl. ..... 123/467; 123/299
(58) Field of Search ..... 123/467, 299, 123/305; 239/96, 533.2, 533.3, 533.4, 533.12

(56) References Cited

U.S. PATENT DOCUMENTS 6,378,503 B1 * 4/2002 Lambert ..... 123/468
6,725,838 B2 * 4/2004 Shafer et al. ..... 123/446
6,769,635 B2 * 8/2004 Stewart et al. ..... 239/558

* cited by examiner

*Primary Examiner*—Mahmoud Gimie
(74) *Attorney, Agent, or Firm*—Ronald E. Greigg

(57) ABSTRACT

A fuel injection apparatus having a high-pressure fuel pump and a fuel injection valve for each cylinder. An electrically actuated control valve controls a connection of the pump working chamber to a discharge region. A first injection valve element controls at least one first injection opening and a second injection valve element guided inside the first injection valve element controls at least one second injection opening. Pressure in a control chamber acts on the second injection valve element at least indirectly in the closing direction. By means of a connection controlled by a valve, the control pressure chamber is connected to a pressure region in which a respective pressure increase and decrease are delayed in relation to pressure in the pump working chamber when the control valve respectively closes and opens. The valve is acted on in the opening direction by the pressure prevailing in the pressure region and the closing direction by the pressure prevailing in the pump working chamber.

20 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 03/00585 filed on Feb. 25, 2003.

BACKGROUND OF THE INVENTION

1. Field of the Invention

The invention is directed to an improved fuel injection apparatus for an internal combustion engine, including a high-pressure fuel pump and a fuel injection valve connected to the fuel pump for each cylinder of the engine.

2. Description of the Prior Art

A fuel injection apparatus of the type with which this invention is concerned is known from DE 198 35 494 A1. This fuel injection apparatus has a high-pressure fuel pump and a fuel injection valve connected to it for each cylinder of the internal combustion engine. The high-pressure fuel pump has a pump piston that is driven into a stroke motion by the engine and delimits a pump working chamber connected to a pressure chamber of the fuel injection valve. The fuel injection valve has an injection valve element that controls at least one injection opening and, acted on by the pressure prevailing in the pressure chamber, can be moved in an opening direction counter to a closing force in order to open the at least one injection opening. An electrically actuated control valve at least indirectly controls a connection of the pump working chamber to a discharge region in order to control the fuel injection. When the pressure in the pump working chamber and therefore in the pressure chamber of the fuel injection valve reaches the opening pressure, then the injection valve element moves in the opening direction and opens the at least one injection opening. The injection cross section that is controlled by the injection valve element is always the same size. This does not permit an optimal fuel injection in all operating conditions of the internal combustion engine.

SUMMARY OF THE INVENTION

The fuel injection apparatus according to the invention has the advantage over the prior art that by means of the at least one second injection opening, the second injection valve element can open or close an additional amount of injection cross section so that the injection cross section can be optimally adapted to the operating conditions of the engine. The valve successfully executes a reliable, rapid closing of the second injection valve element so that it is possible to avoid or at least to limit an undesirable increase in the injected fuel quantity at the transition from a fuel injection cycle in which only the first injection valve element opens to a fuel injection cycle in which the second injection valve element also opens.

Advantageous embodiments and modifications of the fuel injection apparatus according to the invention are disclosed. In one the pressure region is supplied with pressure in a simple manner without incurring additional expense.

BRIEF DESCRIPTION OF THE DRAWINGS

Exemplary embodiments of the invention are described in detail herein below, with reference to the drawings, in which.

DESCRIPTION OF THE PREFERRED EMBODIMENTS

Figure 1:
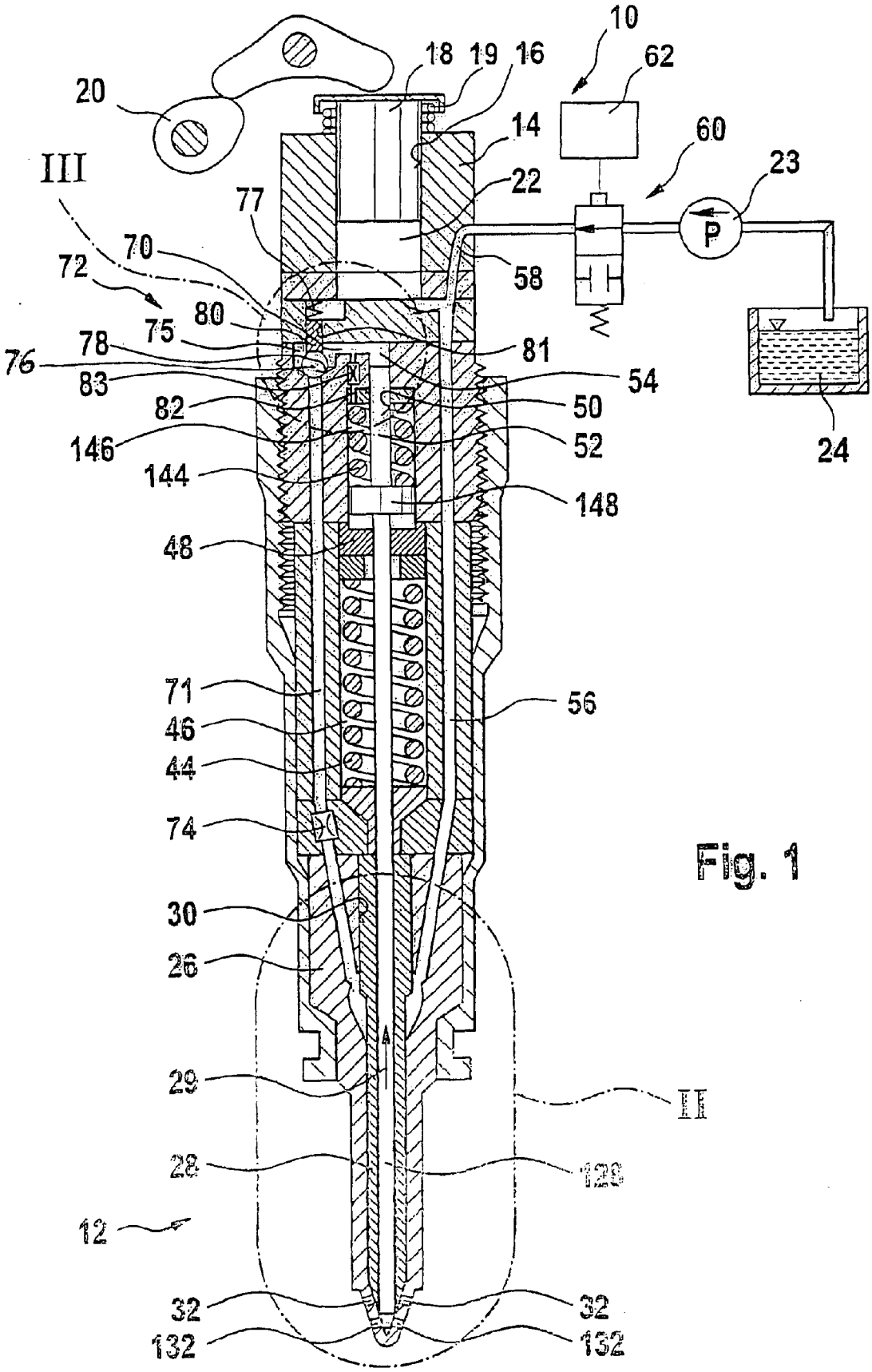
FIG. 1 shows a schematic longitudinal section through a fuel injection apparatus according to the invention for use in an internal combustion engine.
Figure 2:
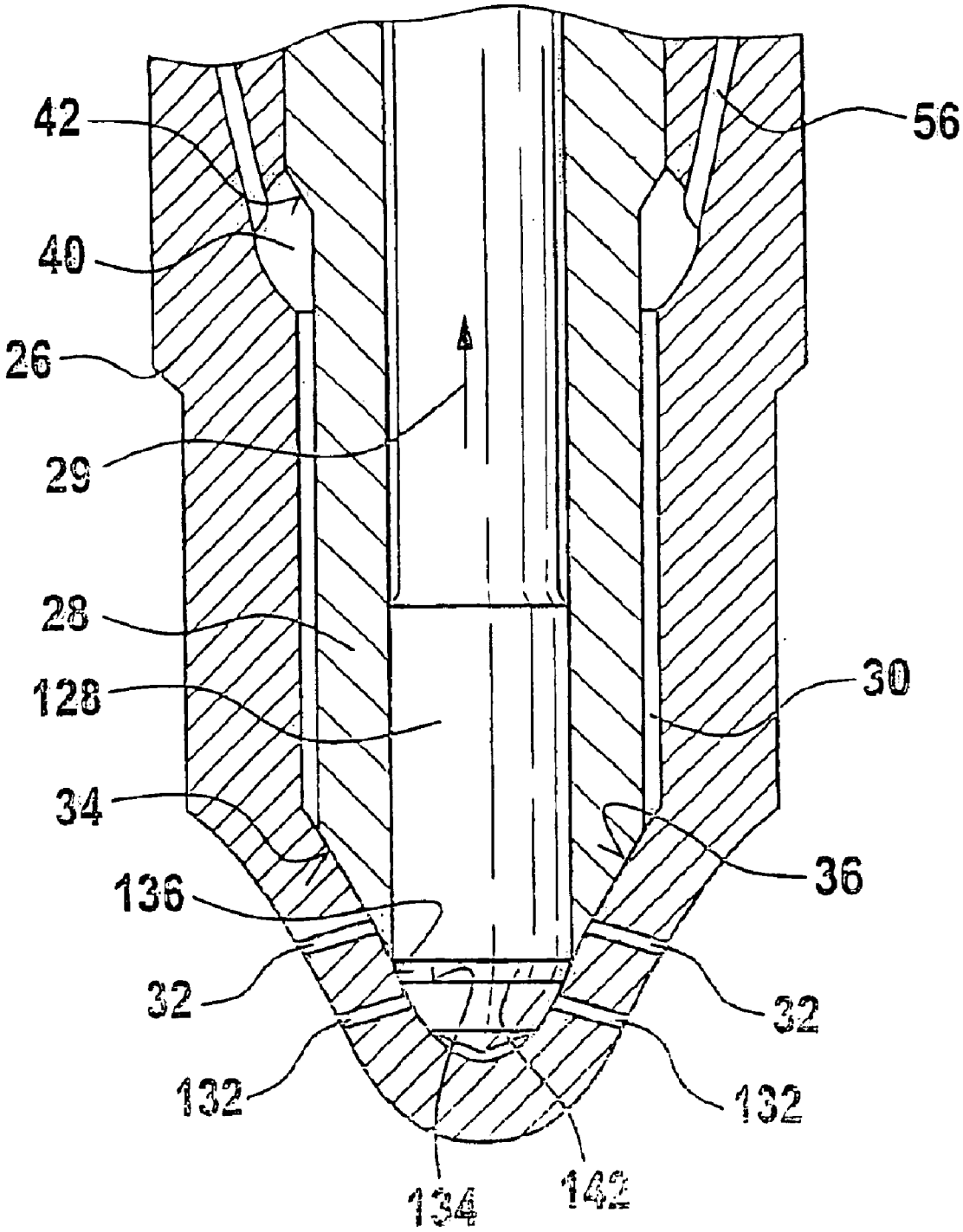
FIG. 2 shows an enlarged detail, labeled II in FIG. 1, of the fuel injection apparatus.
Figure 3:
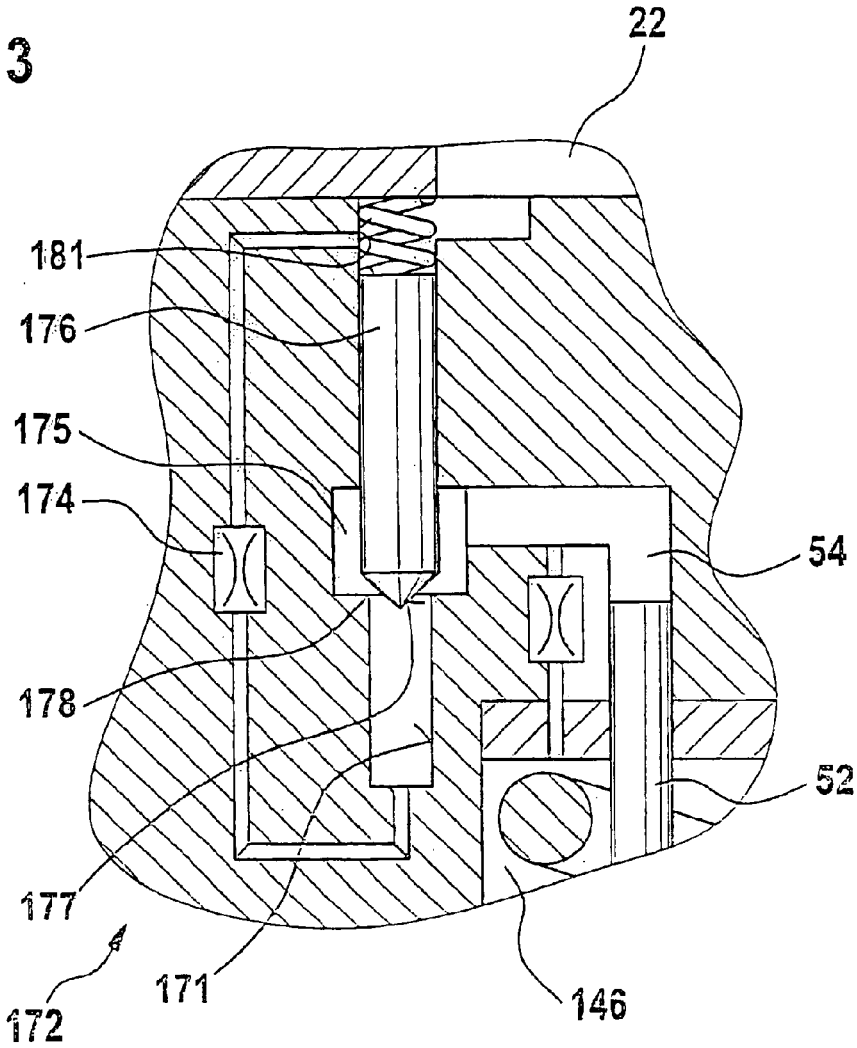
FIG. 3 shows a detail, labeled III in FIG. 1, of the fuel injection apparatus according to a modified embodiment, and FIG. 4 plots stroke curves of injection valve elements of the fuel injection apparatus over time during an injection cycle.

FIGS. 1 to 3 show a fuel injection apparatus for an internal combustion engine of a motor vehicle. The internal combustion engine is preferably an autoignition internal combustion engine. The fuel injection apparatus is embodied as a so-called unit fuel injector or unit pump system and has a high-pressure fuel pump 10 and a fuel injection valve 12 connected to it for each cylinder of the engine. When the apparatus is embodied as a unit pump system, the high pressure fuel pump 10 is disposed separate from the fuel injection valve 12 and is connected to it via a line. In the exemplary embodiment shown, the fuel injection apparatus is embodied as a unit fuel injector in which the high-pressure fuel pump 10 and the fuel injection valve 12 are connected directly to each other and form a structural unit. The high-pressure fuel pump 10 has a pump piston 18 that is guided in a cylinder bore 16 in a sealed fashion and is driven into a stroke motion counter to the force of a return spring 19 by a cam 20 of a camshaft of the internal combustion engine. Inside the cylinder 16, the pump piston 18 delimits a pump working chamber 22 in which fuel is compressed at high pressure during the delivery stroke of the pump piston 18. During the intake stroke of the pump piston 18, a fuel-supply pump 23 supplies fuel to the pump working chamber 22 from a fuel tank 24 of the vehicle.

As shown in FIGS. 1 and 2, the fuel injection valve 12 has a valve body 26, which can be comprised of a number of parts, in which a first injection valve element 28 is guided so that it can move longitudinally in a bore 30. As shown in FIG. 2, in its end region oriented toward the combustion chamber of the cylinder of the engine, the valve body 26 has at least one, preferably several, first injection openings 32 that are distributed over the circumference of the valve body 26. In its end region oriented toward the combustion chamber, the first injection valve element 28 has a for example approximately conical sealing surface 34, which cooperates with a valve seat 36 embodied in the end region of the valve body 26 oriented toward the combustion chamber; the first injection openings 32 branch off from this valve seat 36 or branch off downstream of it. In the valve body 26, between the injection valve element 28 and the bore 30, toward the valve seat 36, there is an annular space 38 whose end region oriented away from the valve seat 36, by means of a radial enlargement of the bore 30, transitions into a pressure chamber 40 that encompasses the first injection valve element 28. At the level of the pressure chamber 40, the first injection valve element 28 has a pressure shoulder 42 formed by a cross sectional reduction. The end of the first injection valve element 28 oriented away from the combustion chamber is engaged by a first prestressed closing spring 44, which presses the first injection valve element 28 toward the valve seat 36. The first closing spring 44 is disposed in a first spring chamber 46 of the valve body 26, adjoining the bore 30.

The first injection valve element 28 of the fuel injection valve 12 is embodied as hollow and a second injection valve element 128 is guided inside it so that it can slide in a coaxial bore embodied in the injection valve element 28. The second injection valve element 128 controls at least one, preferably several second injection openings 132 in the valve body 26. The second injection openings 132 are offset in relation to the at least one first injection opening 32 toward the combustion chamber in the direction of the longitudinal axis of the injection valve elements 28, 128. In its end region oriented toward the combustion chamber, the second injection valve element 128 has a for example approximately conical sealing surface 134, which cooperates with a valve seat 136 embodied in the end region of the valve body 26 oriented toward the combustion chamber, the second injection openings 132 branch off from this valve seat 136 or branch off downstream of it. The second injection valve element 128 can be embodied in two parts: one part that has the sealing surface 134 and is oriented toward the combustion chamber and a second part that adjoins the first part at its end oriented away from the combustion chamber. Close to the combustion chamber end of the second injection valve element 128, it has a pressure surface 142 that is acted on by the pressure prevailing in the pressure chamber 40 when the first injection valve element 28 is open.

As shown in FIG. 1, the end of the first spring chamber 46 oriented away from the combustion chamber is adjoined by a second spring chamber 146 in the valve body 26, which contains a second closing spring 144 that acts on the second injection valve element 128 in the closing direction. The second spring chamber 146 is divided from the first spring chamber 46 by a wall 48 that is press-fitted into the valve body 26. The first closing spring 44 is supported against the wall 48 possibly by means of a precision washer. The second injection valve element 128 passes through a bore in the dividing wall 48 and protrudes into and through the second spring chamber 146. The second closing spring 144 is clamped between the end of the second spring chamber 146 and a spring plate 148 of the second injection valve element 128. The two spring chambers 46, 146 are each connected to a discharge region so that a low pressure prevails in them. A bore 50 with a smaller diameter than the second spring chamber 146 adjoins the end of the spring chamber 146 oriented away from the combustion chamber. A control piston 52, which is guided in a sealed fashion in the bore 50, is supported at one end against the second injection valve element 128, for example by means of the spring plate 148, and at its other end, delimits a control pressure chamber 54 in the bore 50.

Starting from the pump working chamber 22, a connection 56 extends through the pump body 14 and the valve body 26 into the pressure chamber 40 of the fuel injection valve 12. The pump working chamber 22 also has a connection 58 to a discharge region, which function can be served by the fuel-supply pump 23 or the fuel tank 24. An electrically actuated control valve 60 controls the connection 58 of the pump working chamber 22 to the discharge region. The control valve 60 can be embodied as a 2/2-way valve and can have an electromagnetic or piezoelectric actuator. The control valve 60 is triggered by an electronic control unit 62 as a function of operating parameters of the internal combustion engine, in order to control the timing and duration of the fuel injection and therefore also the quantity of fuel injected. During the intake stroke of the pump piston 18, the control valve 60 is open so that the pump working chamber 22 is supplied with fuel by the fuel-supply pump 23. During the delivery stroke of the pump piston 18, the control unit 62 closes the control valve 60 at a particular time so that high pressure can build up in the pump working chamber 22 in accordance with the stroke of the pump piston 18.

The control pressure chamber 54 has a connection 70 to a pressure region 71, which is in turn connected to the pressure chamber 40. The connection 70 is controlled by a valve 72 and extends outward in an approximately radial direction starting from the bore 50 that contains the control pressure chamber 54. The pressure region 71 is embodied as a longitudinal bore 71 that extends through the valve body 26 to the pressure chamber 40, approximately parallel to the injection valve elements 28, 128. The longitudinal bore 71 preferably contains a throttle restriction 74. The longitudinal bore 71 consequently constitutes the pressure region that is supplied with pressure from the pressure chamber 40 and is decoupled from the latter by the throttle restriction 74. In a valve chamber 75 connected to the control pressure chamber 54, the valve 72 has a valve element 76 that can be embodied, for example as shown in FIG. 1, in the form of a ball and cooperates with a valve seat 78 embodied in the valve body 26 in order to control the connection 70. The valve seat 78 is formed at the transition from the valve chamber 75 to the longitudinal bore 71 that constitutes a part of the connection 70 in the valve body 26 and that has a smaller diameter than the valve chamber 75. The valve seat 78 is embodied as at least approximately conical. The valve element 76 is connected to a valve piston 80, which is guided in a sealed fashion in a bore 81 that adjoins the end of the valve chamber 75 oriented away from the valve seat 78. The bore 81 has a connection to the pump working chamber 22 that is not throttled. Consequently, the pressure prevailing in the longitudinal bore 71 acts on the valve element 76 in its opening direction, i.e. away from the valve seat 78, and the pressure prevailing in the pump working chamber 22, via the valve piston 80, acts on the valve element 76 in its closing direction, i.e. toward the valve seat 78. The cross sectional area of the valve element 76 enclosed by the valve seat 78 and the cross sectional area of the valve piston 80 disposed in the bore 81 are preferably at least approximately equal. It is also possible for a spring 77 to act on the valve element 76 in the closing direction toward the valve seat 78. The control pressure chamber 54 and the valve chamber 75 can have a connection 82 to the second spring chamber 146, via which they can then be connected to a discharge region. The connection 82 contains at least one throttle restriction 83.

The function of the fuel injection apparatus will be explained below. During the intake stroke of the pump piston 18, the control valve 60 is open so that the fuel-supply pump 23 supplies fuel from the fuel tank 24 to the pump working chamber 22. During the delivery stroke of the pump piston 18, the control unit 62 closes the control valve 60 at a particular time so that the pump working chamber 22 is disconnected from the fuel-supply pump 23 and high pressure builds up in this chamber in accordance with the stroke of the pump piston 18.

When the pressure in the pump working chamber 22 and therefore in the pressure chamber 40 of the fuel injection valve 12 is high enough that the compressive force it exerts on the first injection valve element 28 via the pressure shoulder 42 is greater than the force of the first closing spring 44, then the fuel injection valve 12 opens: the sealing surface 34 of the first injection valve element 28 lifts up from the valve seat 36 and opens the at least one first injection opening 32. A more rapid pressure increase occurs in the pump working chamber 22 than in the longitudinal bore 71, in which the pressure increase is delayed by the throttle restriction 74. As a result, the valve 72 closes since the valve piston 80, which is acted on by the pressure in the pump working chamber 22, exerts a force on its valve element 76 in the closing direction that is greater than the force in the opening direction exerted by the pressure acting on the valve element 76 via the longitudinal bore 71 with the throttle restriction 74. Depending on the throttle restriction 74 and the transit time of the pressure waves from the pump working chamber 22 to the valve element 76, the pressure increase In the longitudinal bore 71 occurs with a time lag in relation to the pressure increase in the pump working chamber 22. The valve 72 disconnects the control pressure chamber 54 from the pressure chamber 40 so that only a low pressure prevails in the control pressure chamber 54 due to its connection 82 to the spring chamber 146 and in turn, to the discharge region. The force acting on the second injection valve element 128 in the closing direction is consequently determined essentially by the second closing spring 144. When the pressure in the pressure chamber 40, via the pressure surface 142, exerts a force on the second injection valve element 128 in the opening direction 29 that is greater than the force of the second closing spring 144, then the second injection valve element 128 moves in the opening direction 29 and opens the at least one second injection opening 132. When the sealing surface 134 of the second injection valve element 128 lifts up from the second valve seat 136, then the pressure prevailing in the pressure chamber 40 acts on the entire end surface of the injection valve element 128 and consequently on an area significantly greater than that of the pressure surface 142 alone.

It is possible for the injection cross sections comprised by the first injection openings 32 and the second injection openings 132 to be at least approximately equal so that when only the first injection valve element 28 opens, half of the overall injection cross section is opened. Alternatively, it is also possible for the first injection openings 32 to have a larger or smaller injection cross section than the second injection openings 132. In particular, it is possible for the second injection openings 132 to have approximately twice the injection cross section of the first injection openings 32. The first injection valve element 28 always opens before the second injection valve element 128 since the pressure prevailing in the pressure chamber 40 can only act on the pressure surface 142 of the second injection valve element 128 once the first injection valve element 28 is open. If the pressure in the pressure chamber 40 does not exceed the opening pressure of the second injection valve element 128, i.e. the pressure that acts on the pressure surface 142 and produces a force in the opening direction 29 greater than the force of the second closing spring 144, then the second injection valve element 128 remains in its closed position and only the first injection valve element 28 opens. When the pressure in the pressure chamber 40 exceeds the opening pressure of the second injection valve element 128, then the second injection valve element 128 opens with a time lag in relation to the first injection valve element 28.

Figure 4:
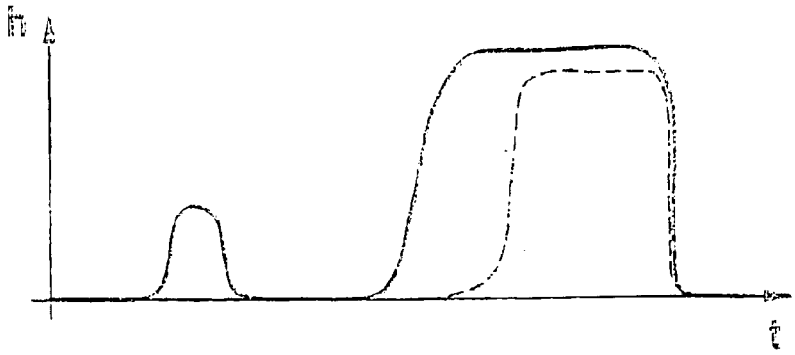
Figure 2:
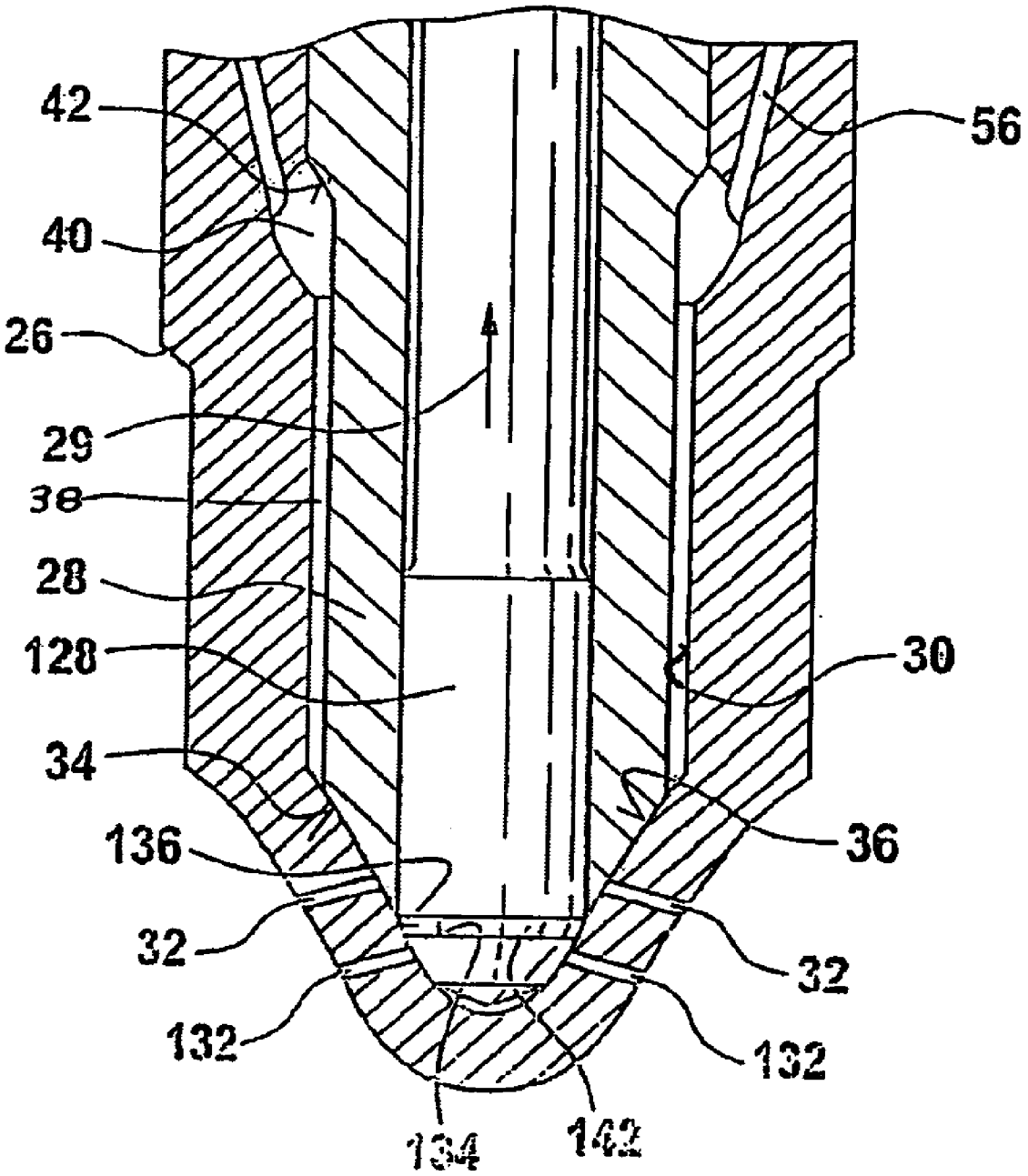
Figure 3:
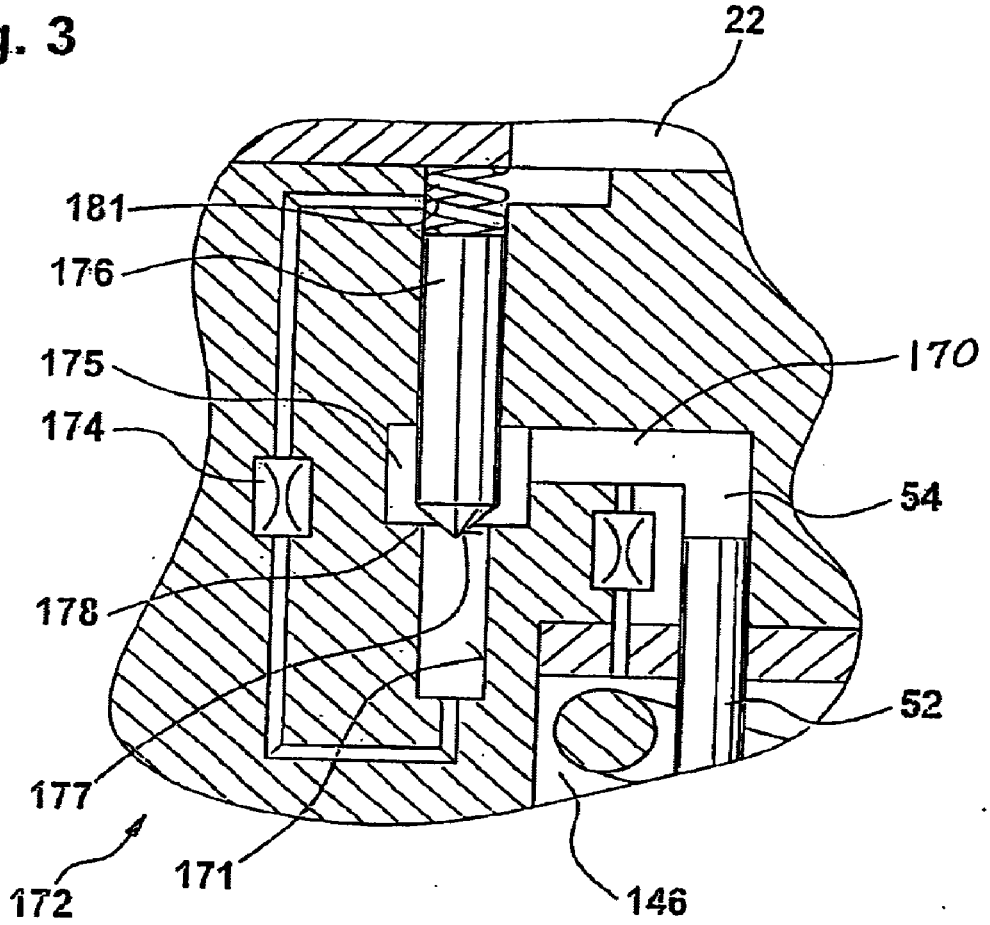
Figure 4:
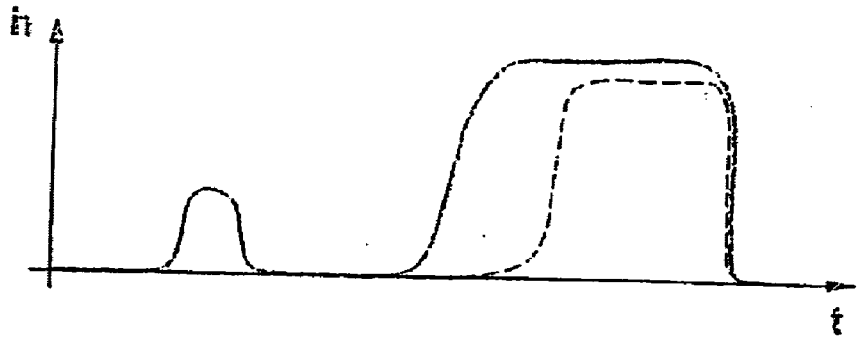

FIG. 4 depicts the curve of the opening stroke h with a solid line for the first injection valve element 28 and with a dashed line for the second injection valve element 128 during an injection cycle over time t. At the beginning of the injection cycle, the pressure in the pressure chamber 40 is still relatively low so that only the first injection valve element 28 opens and only a part of the overall injection cross section in the fuel injection valve 12 is opened. At this point, a preinjection of a small quantity of fuel occurs only via the first injection openings 32. Then the control unit 62 opens the control valve 60 so that the pressure in the pump working chamber 22 and in the pressure chamber 40 decreases, which causes the first injection valve element 28 to close again and terminates the preinjection. At a certain time during the delivery stroke of the pump piston 18, the control unit 62 closes the control valve 60 again so that high pressure builds up in the pump working chamber 22 and the pressure chamber 40. The first injection valve element 28 opens when its opening pressure is exceeded, thus opening the first injection openings 32. When the pressure in the pressure chamber 40 also exceeds the opening pressure of the second injection valve element 128, then it opens, too, thus opening the second injection openings 132. At this point, a main injection of a relatively large fuel quantity occurs via the first and second injection openings 32, 132.

The control unit 62 opens the control valve 60 to terminate the fuel injection cycle. The pressure in the pump working chamber 22 and in the pressure chamber 40 thus decreases so that the first injection valve element 28 is closed by the force of the first closing spring 44. When the control valve 60 opens, a rapid pressure decrease occurs in the pump working chamber 22 whereas the pressure decrease in the longitudinal bore 71 is delayed due to the throttle restriction 74 and the transit time of the pressure waves from the pump working chamber 22 to the valve element 76. Consequently, the relatively high pressure still prevailing in the longitudinal bore 71 exerts a force in the opening direction on the valve element 76 of the valve 72 that is greater than the force exerted in the closing direction by the pressure prevailing in the pump working chamber 22, which is already relatively quite low, thus causing the valve 72 to open. When the valve 72 is open, the control pressure chamber 54 is connected to the longitudinal bore 71 via the connection 70 so that an elevated pressure prevails in the control pressure chamber 54. The elevated pressure in the control pressure chamber 54 exerts a force via the control piston 52, which force adds to the force that the second closing spring 144 exerts on the second injection valve element 128 in the closing direction, thus causing the second injection valve element 128 to close rapidly. The pressure in the pressure chamber 40 decreases rapidly by means of the longitudinal bore 71 with the throttle restriction 74, the open valve 72, and the connection 82 to the throttle restriction 83.

It is also possible at certain operating parameters of the internal combustion engine, in particular at low engine speeds when only a small quantity of fuel is injected, for the pressure prevailing not to exceed the opening pressure of the second injection valve element 128 for the entire delivery stroke of the pump piston 18, during both the preinjection and the main injection, so that only the first injection valve element 28 opens and the second injection valve element 128 remains closed. As the engine speed increases, the pressure that the pump piston 18 generates in the pump working chamber 22 and in the pressure chamber 40 increases so that at high engine speeds, it exceeds the opening pressure of the second injection valve element 128, thus causing this second injection valve element 128 to open in addition to the first injection valve element 28.

FIG. 3 shows the fuel injection apparatus according to a modified embodiment in which, by contrast with the embodiment shown in FIG. 1 and explained above, the valve 172 controls a connection 170 of the control pressure chamber 54 to a pressure region 171 that is connected to the pump working chamber 22 instead of the pressure chamber 40. The pressure region 171 is embodied as a bore that contains the throttle restriction 174 in order to achieve a respective pressure increase and pressure decrease in the bore 171 that are delayed in relation to those respectively occurring in the pump working chamber 22. The valve 172 can be embodied the same as the one in the embodiment in FIG. 1 and can have a valve element in the form of a ball and a valve piston. Alternatively, the valve 172 can also have a piston-shaped valve element 176 that is guided in a sealed fashion in the bore 181. The valve element 176 protrudes into a valve chamber 175 and has a for example conical sealing surface 177 with which it cooperates with the valve seat 178 in order to control the connection 170. Alternatively, the valve element 176 can also have a for example spherically curved sealing surface 177. The valve chamber 175 adjoins the bore 171, which contains the throttle restriction 174 and feeds into the pump working chamber 22. The pressure prevailing in the bore 171 acts in the opening direction on the surface of the valve element 176 encompassed by the valve seat 178 and the pressure prevailing in the pump working chamber 22 acts in the closing direction on the surface of the valve element 176 disposed in the bore 181. When the control valve 60 closes, a pressure increase occurs in the bore 171, which is delayed in comparison to that occurring in the pump working chamber 22, thus causing the valve 172 to close. When the control valve 60 opens, a pressure decrease occurs in the bore 171, which is delayed in comparison to that occurring in the pump working chamber 22, thus causing the valve 172 to open. The function of the fuel injection apparatus is the same as the one described previously. The embodiment of the valve 172 with the piston-shaped valve element 176 can also be used in the embodiment of the fuel injection apparatus according to FIG. 1.

The foregoing relates to preferred exemplary embodiments of the invention, it being understood that other variants and embodiments thereof are possible within the spirit and scope of the invention, the latter being defined by the appended claims.

What is claimed is:

1. A fuel injection apparatus for an internal combustion engine, the apparatus comprising a high-pressure fuel pump (10) and a fuel injection valve (12) connected to it for each cylinder of the engine, the high-pressure fuel pump (10) having a pump piston (18) that is driven into a stroke motion by the engine and delimiting a pump working chamber (22) connected to a pressure chamber (40) of the fuel injection valve (12), the fuel injection valve (12) having at least one first injection valve element (28) that controls at least one first injection opening (32) and can be moved in an opening direction (29) counter to a closing force by the pressure prevailing in the pressure chamber (40) in order to open the at least one first injection opening (32), and an electrically actuated control valve (60) that at least indirectly controls a connection of the pump working chamber (22) to a discharge region (24), the fuel injection valve (12) having a second injection valve element (128) guided so that it can slide inside the first injection valve element (28), the first injection valve element (28) being embodied as hollow, the second injection valve element (128) controlling at least one second injection opening (132) and being supported for movement in an opening direction (29) counter to a second closing force by the pressure prevailing in a pressure chamber (40) in order to open the at least one second injection opening (132), the second injection valve element (128) being acted on at least indirectly in a closing direction by the pressure prevailing in a fuel-filled control pressure chamber (54), the control pressure chamber (54) is connected by means of a connection (70; 170) controlled by a valve (72; 172), to a pressure region (71; 171) in which a respective pressure increase and pressure decrease are delayed in relation to those occurring in the pump working chamber (22) when the control valve (60) respectively closes and opens, and the valve (72; 172) having a valve element (76, 80; 176) that is acted on in the opening direction by the pressure prevailing in the pressure region (71; 171) and is acted on in the closing direction by the pressure prevailing in the pump working chamber (22).

2. The fuel injection apparatus according to claim 1, wherein the pressure region (71) is connected to the pressure chamber (40) of the fuel injection valve (12) and is decoupled from it preferably by means of a throttle restriction (74).

3. The fuel injection apparatus according to claim 1, wherein the pressure region (171) is connected to the pump working chamber (22) and is decoupled from it by means of a throttle restriction (174).

4. The fuel injection apparatus according to claim 1, wherein the valve element (76) is connected to a valve piston (80) that is guided in a sealed fashion in a valve bore (81) and is acted on in the closing direction of the valve element (76) by the pressure prevailing in the pump working chamber (22).

5. The fuel injection apparatus according to claim 2, wherein the valve element (76) is connected to a valve piston (80) that is guided in a sealed fashion in a valve bore (81) and is acted on in the closing direction of the valve element (76) by the pressure prevailing in the pump working chamber (22).

6. The fuel injection apparatus according to claim 3, wherein the valve element (76) is connected to a valve piston (80) that is guided in a sealed fashion in a valve bore (81) and is acted on in the closing direction of the valve element (76) by the pressure prevailing in the pump working chamber (22).

7. The fuel injection apparatus according to claim 1, wherein the second injection valve element (128) is connected to a control piston (52) that delimits the control pressure chamber (54).

8. The fuel injection apparatus according to claim 2, wherein the second injection valve element (128) is connected to a control piston (52) that delimits the control pressure chamber (54).

9. The fuel injection apparatus according to claim 3, wherein the second injection valve element (128) is connected to a control piston (52) that delimits the control pressure chamber (54).

10. The fuel injection apparatus according to claim 4, wherein the second injection valve element (128) is connected to a control piston (52) that delimits the control pressure chamber (54).

11. The fuel injection apparatus according to claim 5, wherein the second injection valve element (128) is connected to a control piston (52) that delimits the control pressure chamber (54).

12. The fuel injection apparatus according to claim 6, wherein the second injection valve element (128) is connected to a control piston (52) that delimits the control pressure chamber (54).

13. The fuel injection apparatus according to claim 1, wherein the control pressure chamber (54) is connected to a discharge region at least indirectly via a connection (82) that contains a throttle restriction (83).

14. The fuel injection apparatus according to claim 2, wherein the control pressure chamber (54) is connected to a discharge region at least indirectly via a connection (82) that contains a throttle restriction (83).

15. The fuel injection apparatus according to claim 3, wherein the control pressure chamber (54) is connected to a discharge region at least indirectly via a connection (82) that contains a throttle restriction (83).

16. The fuel injection apparatus according to claim 4, wherein the control pressure chamber (54) is connected to a discharge region at least indirectly via a connection (82) that contains a throttle restriction (83).

17. The fuel injection apparatus according to claim 5, wherein the control pressure chamber (54) is connected to a discharge region at least indirectly via a connection (82) that contains a throttle restriction (83).

18. The fuel injection apparatus according to claim 6, wherein the control pressure chamber (54) is connected to a discharge region at least indirectly via a connection (82) that contains a throttle restriction (83).

19. The fuel injection apparatus according to claim 7, wherein the control pressure chamber (54) is connected to a discharge region at least indirectly via a connection (82) that contains a throttle restriction (83).

20. The fuel injection apparatus according to claim 8, wherein the control pressure chamber (54) is connected to a discharge region at least indirectly via a connection (82) that contains a throttle restriction (83).

* * * * *

UNITED STATES PATENT AND TRADEMARK OFFICE

CERTIFICATE OF CORRECTION

PATENT NO. : 6,973,918 B2
DATED : December 13, 2005
INVENTOR(S) : Peter Boehland et al.

It is certified that error appears in the above-identified patent and that said Letters Patent is hereby corrected as shown below:

Drawings,
The sheets of drawings consisting of figures 2 and 3 should be deleted to appear as attached figures 2 and 3.

Signed and Sealed this

Thirtieth Day of May, 2006

JON W. DUDAS
*Director of the United States Patent and Trademark Office*